US009028277B2

(12) United States Patent
Nemoto

(10) Patent No.: US 9,028,277 B2
(45) Date of Patent: May 12, 2015

(54) TERMINAL LOCKING STRUCTURE IN CONNECTOR HOUSING

(71) Applicant: Yazaki Corporation, Minato-ku, Tokyo (JP)

(72) Inventor: Shin Nemoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 133 days.

(21) Appl. No.: 13/937,272

(22) Filed: Jul. 9, 2013

(65) Prior Publication Data

US 2013/0295794 A1 Nov. 7, 2013

Related U.S. Application Data

(63) Continuation of application No. PCT/JP2011/007283, filed on Dec. 27, 2011.

(30) Foreign Application Priority Data

Jan. 12, 2011 (JP) ..... 2011-004115

(51) Int. Cl.
*H01R 13/40* (2006.01)
*H01R 13/422* (2006.01)

(52) U.S. Cl.
CPC ..... *H01R 13/422* (2013.01); *H01R 13/4226* (2013.01)

(58) Field of Classification Search
CPC ..... H01R 13/4223; H01R 13/4365; H01R 13/4364; H01R 13/4362
USPC ..... 439/595, 746, 752
See application file for complete search history.

(56) References Cited

U.S. PATENT DOCUMENTS

| | | | | |
|---|---|---|---|---|
| 4,664,460 | A | 5/1987 | Vandame | |
| 4,864,719 | A | 9/1989 | Rudy, Jr. et al. | |
| 5,009,615 | A * | 4/1991 | Mobley et al. | 439/595 |
| 5,057,040 | A | 10/1991 | Kodama et al. | |
| 5,980,318 | A | 11/1999 | Morello et al. | |
| 2001/0002347 | A1 | 5/2001 | Yoshida et al. | |
| 2011/0117795 | A1 * | 5/2011 | Sakamoto | 439/746 |
| 2014/0017958 | A1 * | 1/2014 | Nemoto | 439/682 |

FOREIGN PATENT DOCUMENTS

| | | | |
|---|---|---|---|
| EP | 1104051 | A2 | 5/2001 |
| JP | 2002-367706 | A | 12/2002 |

* cited by examiner

*Primary Examiner* — Hae Moon Hyeon
(74) *Attorney, Agent, or Firm* — Marvin A. Motsenbocker; Mots Law, PLLC

(57) ABSTRACT

A terminal locking structure for locking a terminal in a terminal accommodation chamber of a connector housing, the terminal locking structure comprises: a locking lance configured to lock the terminal to prevent the terminal from coming off from the terminal accommodation chamber, the locking lance being bendable in a direction intersecting the insertion direction of the terminal into the terminal accommodation chamber; and a flexible arm bendable in the direction intersecting the insertion direction of the terminal into the terminal accommodation chamber together with the locking lance, the flexible arm being formed extending from a front end of the locking lance to the insertion opening side provided for a corresponding terminal in the terminal accommodation chamber and being connected to an inner wall of the terminal accommodation chamber.

4 Claims, 6 Drawing Sheets

TERMINAL LOCKING STRUCTURE IN CONNECTOR HOUSING

CROSS REFERENCE TO RELATED APPLICATIONS

This application is a continuation application of International Application No. PCT/JP2011/007283, filed on Dec. 27, 2011, which claims priority to Japanese Patent Application No. 2011-004115, filed on Jan. 12, 2011, the entire contents of which are incorporated by references herein.

BACKGROUND OF THE INVENTION

1. Field of the Invention

The present invention relates to a terminal locking structure to retain a terminal inside a terminal accommodation chamber of a connector housing.

2. Description of the Related Art

When installing a terminal of a connector into a connector housing, the terminal is inserted into the terminal accommodation chamber of the connector housing, and is locked by a locking lance provided inside the terminal accommodation chamber. With this locking, the terminal is prevented from coming off from the terminal accommodation chamber. In the connector housing having such a terminal locking structure, a pair of locking lances is provided at both sidewalls of the terminal accommodation chamber in order to decrease the height thereof (see Japanese Patent Application Laid-Open No. 2002-367706). Each of the locking lances is formed in a bendable manner in a direction (the transverse direction) intersecting the terminal insertion direction.

FIGS. 1 and 2 show a connector 100 which has a terminal locking structure disclosed in Japanese Patent Application Laid-Open No. 2002-367706. A pair of locking lances 115 and 115 is provided inside a terminal accommodation chamber 111. Each locking lance 115 is bendable in the transverse direction (the up-down direction of FIG. 1). The connector 100 includes: a connector housing 110 to accommodate a terminal (a female terminal) 200, and a retainer 130 attached to the front end portion of the connector housing 110.

The connector housing 110 includes a plurality of terminal accommodation chambers 111. As shown in FIG. 1, the left and right side walls 113 of each of the terminal accommodation chambers 111 are provided with the locking lances 115 and 115, which make a pair. Each of the paired locking lances 115 and 115 includes a locking protrusion 117 which locks the terminal 200. The locking protrusion 117 is provided at a front end serving as a free end of the locking lance 115, and a base end side of the locking lance 115 is integrated with the sidewall 113 to be fixed to the sidewall 113. That is, each of the locking lances 115 is formed as a cantilever which is fixed to the sidewall 113 at one end thereof. When the terminal 200 is inserted into the terminal accommodation chamber 111, each of the locking lances 115 is bent so as to be distant from the terminal 200 and is returned so as to be locked to the rear side of a corresponding terminal contact portion 210 at the front end portion of the terminal 200. With this locking, the terminal 200 is prevented from coming off from the terminal accommodation chamber 111.

The retainer 130 is attached to the front end portion of the connector housing 110 to cover the front end portion thereof. That is, the upper half (the left half of FIG. 1) of the terminal accommodation chamber 111 is covered by the retainer 130. A penetration hole 131 is formed in the retainer 130, and the penetration hole 131 corresponds to the terminal accommodation chamber 111 of the connector housing 110. Further, a bending regulation piece 133 is provided in the retainer 130. The bending regulation piece 133 is inserted between the locking lance 115 and the sidewall 113 of the terminal accommodation chamber 111 to regulate the bending of the locking lance 115 in the lock releasing direction. Furthermore, a tool insertion hole 135 is formed in the retainer 130. The tool insertion hole 135 is formed so as to be parallel to each penetration hole 131. When a release tool (not shown) is inserted from the tool insertion hole 135 into the terminal accommodation chamber 111, the locking lance 115 is bent to release the locking with respect to the terminal 200, thereby allowing the terminal 200 to be extracted.

In the connector which locks the terminal as described above, there are two structures that are disclosed as the locking lance. In a first structure, a locking surface of a locking protrusion 117 in one of the pair of locking lances is inclined. In the first structure, when extracting a terminal from a terminal accommodation chamber, a release tool (not shown) is inserted into the terminal accommodation chamber, and bends only the other locking lance so as to release the locking. In this state, when the terminal is pulled in a release direction, the terminal comes into contact with the inclined surface of the one locking lance, and the one locking lance 115 starts to be bent. Finally, the locking to the terminal is released.

In a second structure, any locking protrusions of a pair of locking lances do not have an inclined surface. In this structure, since the locking lances are locked to the terminal 200 with the same locking force from both sides thereof, the strong locking can be performed. When extracting the terminal from a terminal accommodation chamber, two release tools are inserted from a retainer (cf. FIG. 2) into the terminal accommodation chamber, and the two inserted release tools respectively bend locking lances 115 so as to release the locking.

SUMMARY OF THE INVENTION

The terminal locking structure of the related art needs the aforementioned retainer to regulate the bending of the locking lance in the lock releasing direction. Therefore, the number of components of the connector increases, and the structure becomes complex.

Further, in the locking lances of the first structure, one of the pair of locking lances is bent by a release tool, and the locking of the bent locking lance is released. However, since the locking surface of the locking protrusion in the other locking lance is formed as an inclined surface, the locking force to the terminal is small as a whole. Compared with this, in the second structure, the locking force to the terminal is large. However, a release tool generally has a small mechanical strength, and thus it is difficult to bend the locking lances. Additionally, since respective locking by the pair of locking lances needs to be simultaneously released, such lock releasing operation is not easy.

Therefore, it is an object of the invention to provide a terminal locking structure capable of decreasing the number of components since a retainer is not needed in a connector with a locking lance bendable in the transverse direction and easily releasing the locked state of the locking lance.

An aspect of the present invention is a terminal locking structure for locking a terminal in a terminal accommodation chamber of a connector housing. The terminal locking structure comprises: a locking lance configured to lock the terminal to prevent the terminal from coming off from the terminal accommodation chamber, the locking lance being bendable in a direction intersecting the insertion direction of the terminal into the terminal accommodation chamber; and a flexible arm bendable in the direction intersecting the insertion direction of the terminal into the terminal accommodation chamber together with the locking lance, the flexible arm being formed extending from a front end of the locking lance to the insertion opening side provided for a corresponding terminal in the terminal accommodation chamber and being connected to an inner wall of the terminal accommodation chamber.

The terminal locking structure may comprise: a terminal holding wall integrally formed with the flexible arm and the locking lance, the terminal holding wall being configured to press the terminal accommodated in the terminal accommodation chamber toward a wall of the terminal accommodation chamber facing the terminal.

The locking lance and the flexible arm may be provided in each of surfaces of the terminal accommodation chamber facing to each other, and the terminal holding wall may include an insertion detecting surface at a front end thereof, the insertion detecting surface being visible from the insertion opening of the terminal accommodation chamber.

The locking lance may include: a flexible support portion being connected to the terminal insertion side of the terminal accommodation chamber at one end thereof, the other end of the flexible support portion being provided in the insertion opening side of the terminal accommodation chamber; and an engagement portion provided at the front end side of the flexible support portion and engages with the terminal inserted in the terminal accommodation chamber.

According to the present invention, it is possible to provide a terminal locking structure capable of decreasing the number of components since a retainer is not needed in a connector with a locking lance bendable in the transverse direction and easily releasing the locked state of the locking lance.

DESCRIPTION OF THE PREFERRED EMBODIMENTS

As shown in FIGS. 3 to 7, a connector 2 is used as a terminal locking structure 1 according to an embodiment of the present invention.. The connector 2 includes a connector housing 3, a terminal (a female terminal) 4 shown in FIG. 6.

Figure 1:
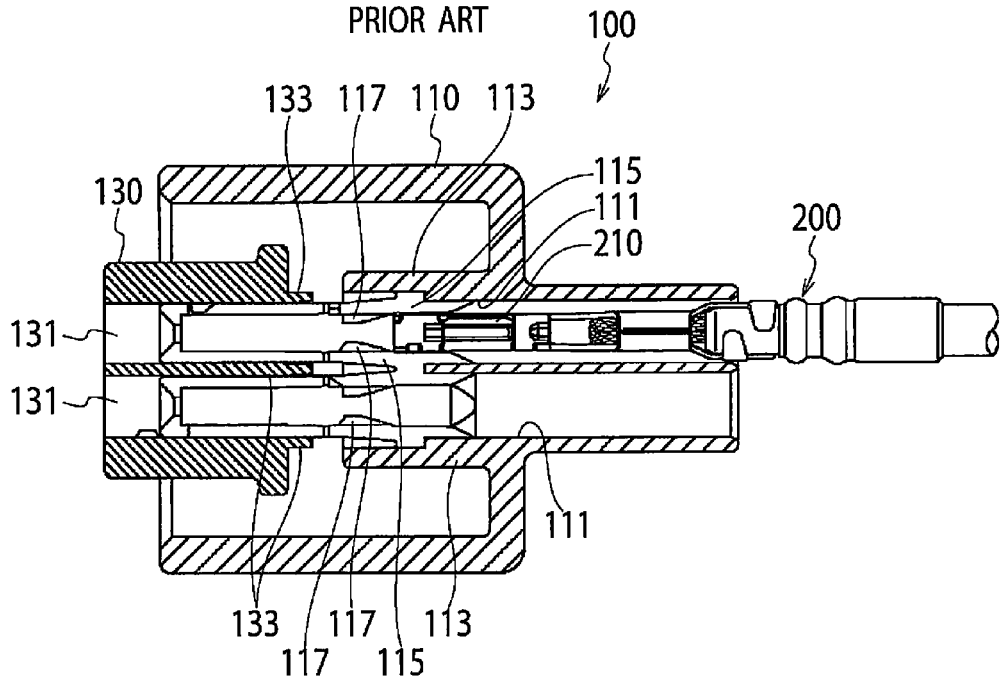
FIG. 1 PRIOR ART
FIG. 1 is a cross-sectional view when the terminal locking structure of the related art.
Figure 2:
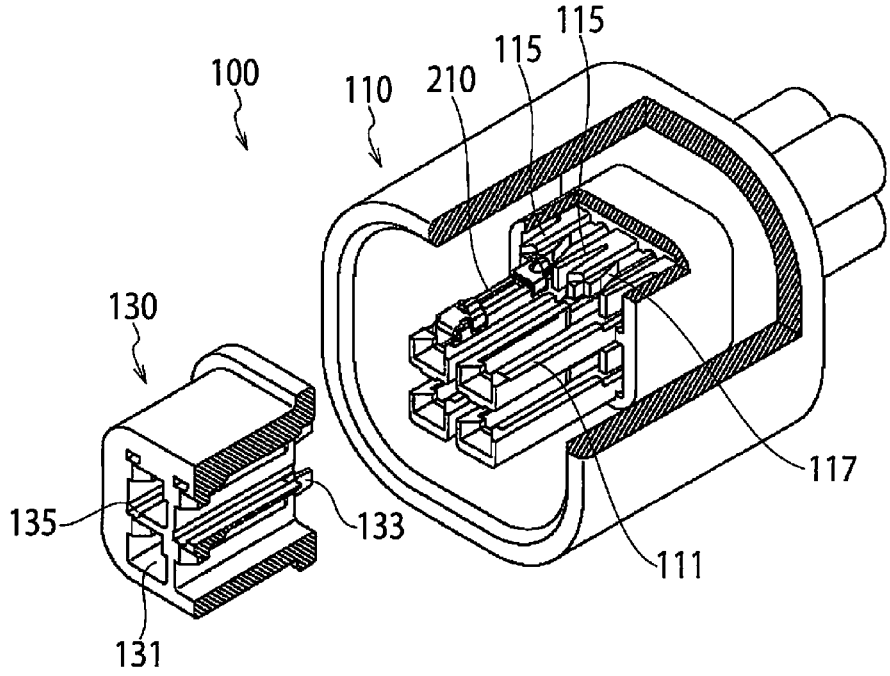
FIG. 2 PRIOR ART
FIG. 2 is an exploded perspective view illustrating a terminal locking structure in a connector of the related art.
Figure 3:
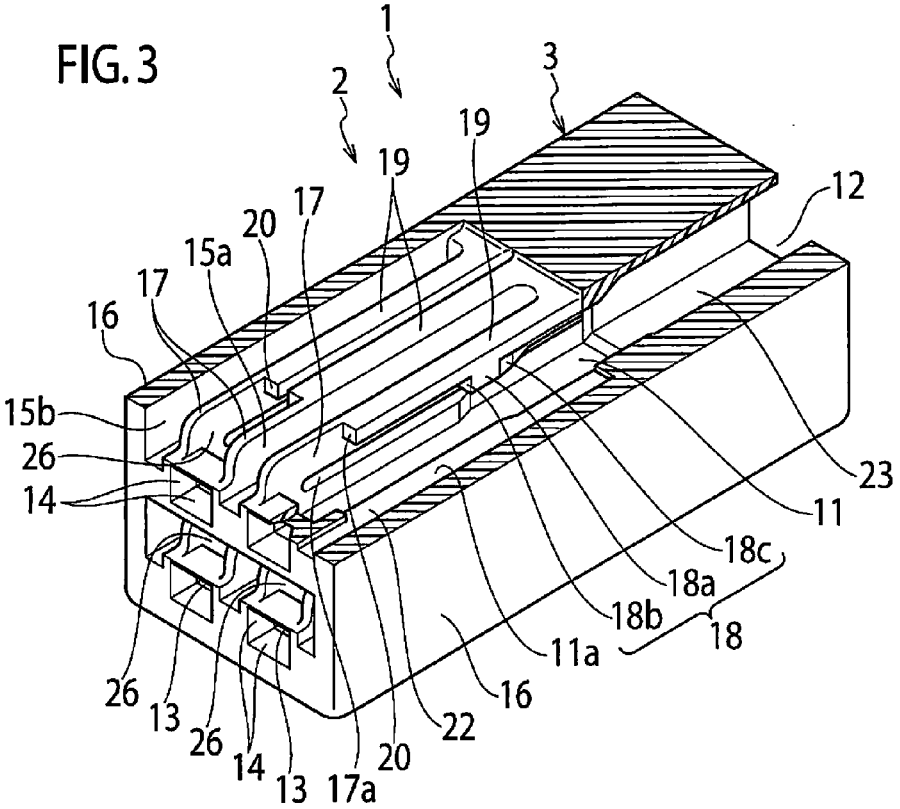
FIG. 3 is a perspective view illustrating a connector used as a terminal locking structure according to an embodiment of the present invention.
Figure 4:
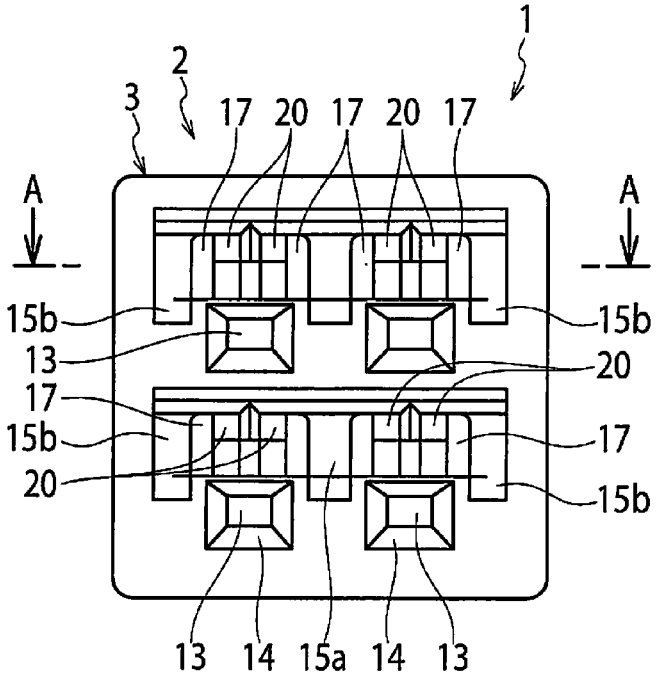
FIG. 4 is a front view of the connector according to the embodiment.
Figure 5:
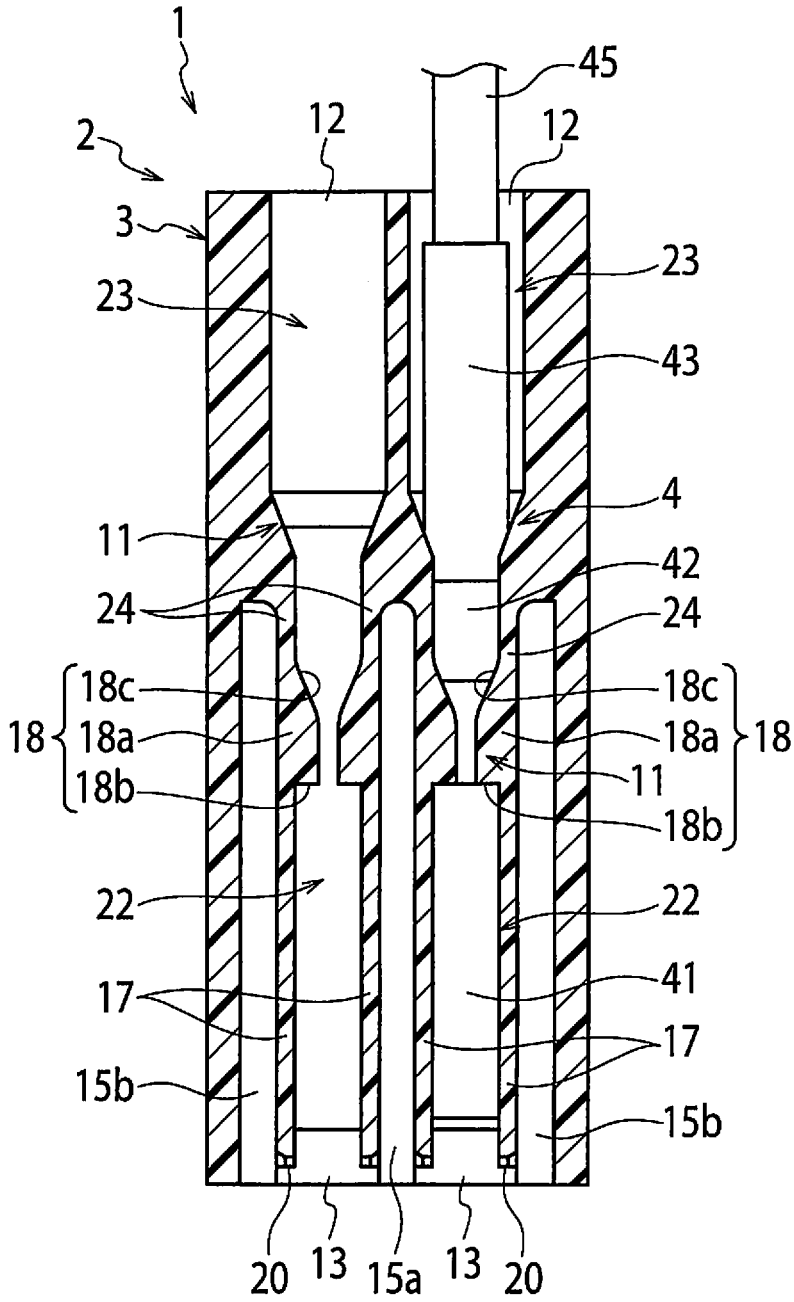
FIG. 5 is a cross-sectional view taken along the line A-A of FIG. 4.

The connector housing 3 is formed by molding of an insulating synthetic resin. The connector housing 3 includes a plurality of terminal accommodation chambers 11, for example, which are horizontally and vertically arranged both in 2 rows as shown in FIGS. 3 to 5. Each terminal accommodation chamber 11 is formed so as to penetrate the connector housing 3 in its lengthwise direction. The terminal 4 is inserted from a rear terminal insertion hole 12 so as to be accommodated in the terminal accommodation chamber 11. An opening (an insertion opening) 13 is formed at an end opposite to the terminal insertion hole 12 in the terminal accommodation chamber 11. A corresponding terminal (e.g. a male terminal) is inserted into the opening 13. The opening 13 is formed in a square shape, and an edge thereof is provided with a terminal guide surface 14. The terminal guide surface 14 is tapered so that the opening 13 is gradually narrowed toward the insertion direction of the corresponding terminal to guide the corresponding terminal to the terminal 4 in the terminal accommodation chamber 11.

Figure 6:
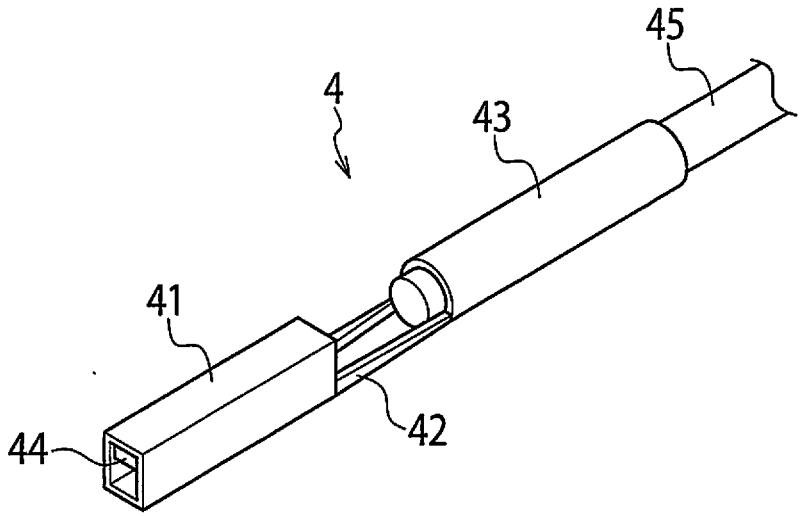
FIG. 6 is a perspective view illustrating a terminal which is used in an embodiment of the invention.

As shown in FIG. 6, the terminal 4 is formed by pressing a conductive metal sheet. The terminal 4 has a shape in which a contact portion (a corresponding terminal contact portion) 41, a connection portion 42, and a crimping portion (a wire crimping portion) 43 are successively (continuously) formed from the front end side toward the rear end side. The contact portion 41 is formed in a rectangular cylindrical shape, and includes therein an elastic contact piece 44 which comes into contact with the front end (the tab) of the corresponding terminal to be electrically connected thereto. The crimping portion 43 is electrically connected to a wire 45 by crimping the wire 45. The connection portion 42 electrically connects the crimping portion 43 and the contact portion 41 to each other. Further, the connection portion 42 is formed so as to be thinner than the contact portion 41 and the crimping portion 43, and the upper space thereof allows an engagement portion (to be described later) to be locked to the contact portion 41. The terminal 4 with the above-described structure is inserted into the terminal accommodation chamber 11 from the contact portion 41.

As shown in FIGS. 3 and 5, each of the terminal accommodation chambers 11 includes two sets of flexible arms 17 and locking lances 18. The set including one flexible arm 17 and one locking lance 18 is provided in each of surfaces of the terminal accommodation chamber 11 that face to each other. That is, two sets of flexible arms 17 and locking lances 18 are respectively positioned at the left and right sides with respect to the terminal 4 which is inserted in the terminal accommodation chamber 11.

The flexible arms 17 and the locking lances 18 are provided in a front area 22 of the terminal accommodation chamber 11. The front area 22 corresponds to the contact portion 41 of the terminal 4 which is inserted in the terminal accommodation chamber 11. A rear area 23 is provided in the insertion side (that is, the rear side) of the terminal 4 in relation to the front area 22. The connection portion 42 and the crimping portion 43 of the terminal 4 are inserted into the rear area 23 to be accommodated therein (see FIG. 5).

The flexible arm 17 and the locking lance 18 are both formed extending toward the opening 13 for the corresponding terminal of the terminal accommodation chamber 11. These are bent so as to move away from the terminal 4 in the direction intersecting the insertion direction of the terminal 4 (that is, the transverse direction of FIG. 5) when the terminal 4 is inserted into the terminal accommodation chamber 11. For allowing the bending, a space 15*a* is provided between the inner flexible arms 17 in the terminal accommodation chambers 11, which are adjacent to each other in the left-right direction. Furthermore, for allowing the bending, a space 15*b* is also provided between the outer flexible arm 17 and the outer surface wall 16 of the connector housing 3 (see FIG. 5). Further, a slot 17*a* to be described later is formed in each flexible arm 17 (see FIG. 3).

As shown in FIGS. 3 and 4, the flexible arm 17 is formed in a thin plate which is upright from a bottom wall 11*a* of the terminal accommodation chamber 11 at both left and right sides of the terminal accommodation chamber 11. Further, the flexible arm 17 is formed so as to linearly extend from the inner wall 24 of the rear area 23 of the terminal accommodation chamber 11 toward the opening 13 thereof. That is, one end of the flexible arm 17 is connected to the inner wall 24 of the terminal accommodation chamber 11, and the other end thereof is supported by the connector housing 3 on the opening 13 side of the terminal accommodation chamber 11.

The upper end of the flexible arm 17 is formed so as to be higher than the opening 13 into which the corresponding terminal is inserted, and the upper portion on the opening 13 side in the terminal accommodation chamber 11 is provided with a tool insertion hole 26. The tool insertion hole 26 allows a release tool 5 to be inserted into the terminal accommodation chamber 11 (see FIGS. 3 and 10).

A slot 17*a* may be formed in the vicinity of a portion of the flexible arm 17 connecting to the bottom wall 11*a*. The slot 17*a* is formed linearly extending from the rear area 23 side of the inner wall 24 toward the opening 13 side thereof so that the space 15*a* (or the space 15*b*) and the terminal accommodation chamber 11 are communicated with each other. In this case, the flexible arm 17 serves as a double-side support beam in which a portion between the end on the opening 13 side and the end on the rear area 23 side is bendable in the above-described transverse direction. Further, the flexible arm 17 serves as a wall (a part of the inner wall 24) which defines the terminal accommodation chamber 11 from the other terminal accommodation chamber 11 and the periphery thereof.

Figure 9:
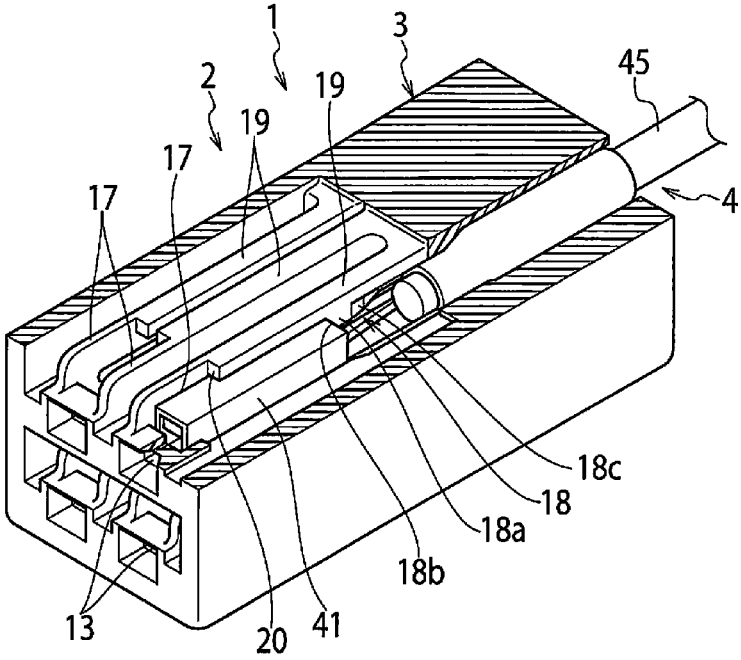
FIG. 9 is a perspective view illustrating a state where the terminal is inserted into the terminal accommodation chamber.

As shown in FIGS. 5 and 9, the locking lance 18 is locked to the terminal 4 inserted in the terminal accommodation chamber 11, and prevents the terminal 4 from coming off from the terminal accommodation chamber 11. For example, as shown in the same drawing, the locking lance 18 is locked to the rear end surface of the contact portion 41 of the terminal 4. The locking lance 18 is integrally formed with the flexible arm 17, and protrudes into the terminal accommodation chamber 11 from the upper portion of the side surface positioned inside the terminal accommodation chamber 11 in the flexible arm 17. The locking lance 18 is also integrally formed with a terminal holding wall 19.

The flexible arm 17 is provided so as to extend toward the opening 13 further than the front end of the locking lance 18. Thus, the mechanical strength of the locking lance 18 which is integrally formed with the flexible arm 17 increases, and the reaction force against the locking lance 18 in the bending direction increases. That is, the locking force of the locking lance 18 with respect to the terminal 4 increases. Further, a retainer which regulates the bending of the locking lance as in the connector of the related art is not needed, thereby decreasing the number of components.

As shown in FIG. 3, a terminal holding wall 19 is provided at the upper portion of the side surface of the flexible arm 17, the side surface facing the inside of the terminal accommodation chamber 11. As same as the locking lance 18, the terminal holding wall 19 is also integrally formed with the flexible arm 17 so as to protrude from the flexible arm 17 toward the inside of the terminal accommodation chamber 11 (see FIG. 3). That is, the flexible arm 17, the locking lance 18, and the terminal holding wall 19 are integrally formed with each other.

The terminal holding wall 19 is formed extending in the lengthwise direction of the flexible arm 17. In other words, the terminal holding wall 19 is formed extending along the flexible arm 17 from the end surface of the rear area 23 of the terminal accommodation chamber 11. Since the flexible arms 17 are provided at both left and right sides of the terminal accommodation chamber 11, the terminal holding walls 19 are also formed at both left and right sides of the terminal accommodation chamber 11. The terminal holding wall 19 presses the terminal 4 (the contact portion 41 of the terminal 4)inserted in the terminal accommodation chamber 11, toward the bottom wall 11*a* of the terminal accommodation chamber 11, and prevents the terminal 4 from coming off from the terminal accommodation chamber 11. Thus, it is possible to stably accommodate the terminal 4 inside the terminal accommodation chamber 11.

As shown in FIGS. 3 and 5, the entire length of the terminal holding wall 19 is shorter than that of the flexible arm 17 in the lengthwise direction of the connector housing 3. The difference in the entire length is made to form the tool insertion hole 26 in the upper portion on the opening 13 side of the terminal accommodation chamber 11, and is also made to form an insertion detecting surface 20 to be described later. With the above-described entire length, the terminal holding wall 19 is terminated inside the terminal accommodation chamber 11, and this termination forms an end surface served as the insertion detecting surface 20. As shown in FIG. 4, the insertion detecting surface 20 can be seen from the opening 13 of the terminal accommodation chamber 11. When the terminal 4 is inserted into the terminal accommodation chamber 11, the pair of flexible arms 17 is bent so as to move away from each other in the direction (the transverse direction) intersecting the insertion direction of the terminal 4. At this time, the terminal holding wall 19 is also bent by the bending of the flexible arm 17. As a result, the insertion detecting surfaces 20 of the pair of flexible arms 17 are displaced so that the gap therebetween is widened. Thus, it is possible to check the insertion state of the terminal 4 into the terminal accommodation chamber 11 by visibly recognizing the widened gap between the insertion detecting surfaces 20.

The locking lance 18 is formed protruding toward the bottom surface 11*a* side (the lower side) of the terminal accommodation chamber 11 from the intermediate portion of the terminal holding wall 19 in the lengthwise direction. Further, the locking lance 18 is integrally formed with the terminal holding wall 19, and protrudes toward the inside of the terminal accommodation chamber 11. With this protruding, the locking lance 18 can be locked to the terminal 4. As described above, the terminal holding wall 19 is integrally formed with the flexible arm 17 and the locking lance 18. Thus, it is possible to increase the mechanical strength of the locking lance 18 and further increase the reaction force in the bending direction. That is, it is possible to increase the locking force of the terminal 4.

The locking lance 18 includes a flexible support portion 18*a* and an engagement portion 18*b*. As shown in FIGS. 3 and 5, the flexible support portion 18*a* is formed along the lengthwise direction of the flexible arm 17. One end (the rear end) of the flexible support portion 18*a* is connected to the rear area 23 located on the terminal insertion side of the terminal accommodation chamber 11. On the other hand, the other end (the front end) of the flexible support portion 18*a* is provided on the opening 13 side. As described above, the locking lance 18 is integrally formed with the flexible arm 17 serving as a double-side support beam, and is supported by the flexible arm 17. Thus, since the mechanical strength of the locking lance 18 increases and the reaction force against the locking lance 18 in the bending direction increases, the locking lance 18 may be strongly locked to the terminal 4.

The flexible support portion 18*a* includes a tapered surface 18*c* on the rear area 23 side thereof. The tapered surface 18*c* is inclined with respect to the insertion direction of the terminal 4, and the front end surface of the contact portion 41 of the terminal 4 comes into contact with the tapered surface when the terminal 4 is inserted into the terminal accommodation chamber 11. With this contact, a bending force is generated in the flexible support portion 18*a* in the transverse direction intersecting the insertion direction of the terminal 4, and the locking lance 18 is deformed so as to be bent in the same direction together with the flexible arm 17.

The flexible support portion 18*a* includes the engagement portion 18*b* in the front end thereof (that is, the end on the opening 13 side). The engagement portion 18*b* engages with the terminal 4. The engagement portion 18*b* has a plane in which the front end of the flexible support portion 18*a* is perpendicular to the terminal insertion direction, and forms a step with respect to the inner surface of the flexible arm 17. The engagement portion 18*b* is locked to the rear end surface of the contact portion 41 of the terminal 4 inserted in the terminal accommodation chamber 11. With this locking, the terminal 4 is prevented from coming off from the terminal accommodation chamber 11.

Figure 8:
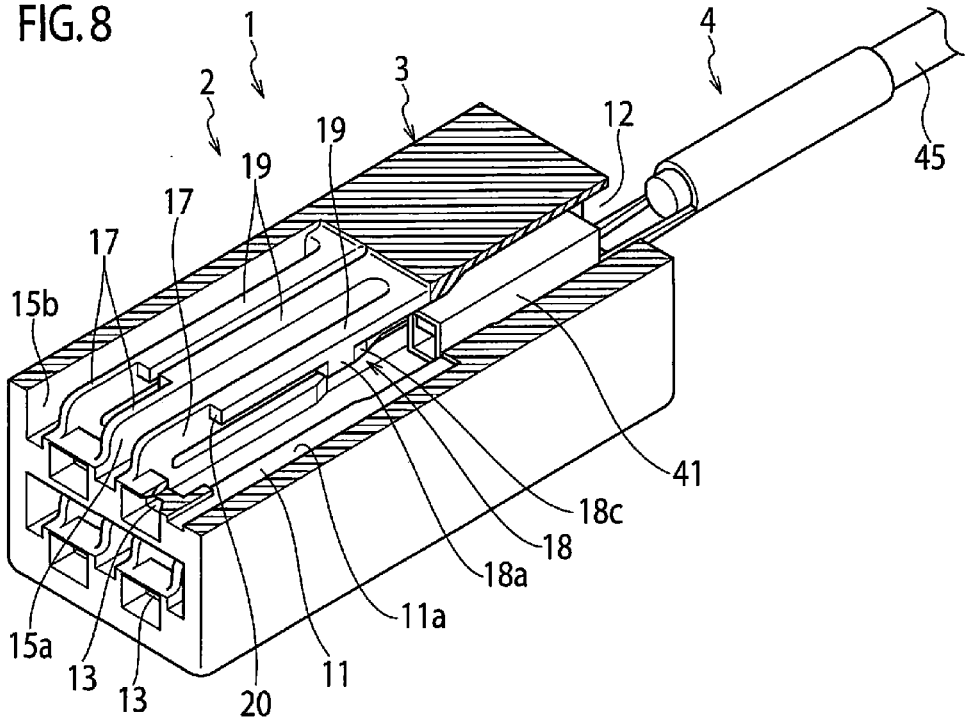
FIG. 8 is a perspective view illustrating an operation in which a terminal is first inserted into a terminal accommodation chamber.

FIGS. 8 and 9 show an operation in insertion of the terminal 4 into the terminal accommodation chamber 11. As shown in FIG. 8, the terminal 4 is inserted into the terminal accommodation chamber 11 from the contact portion 41 thereof through the terminal insertion hole 12. When the terminal 4 is inserted into the terminal accommodation chamber 11, the contact portion 41 comes into contact with the tapered surface 18*c* of the locking lance 18. Accordingly, the locking lance 18, the flexible arm 17, and the terminal pressing wall 19 are integrally bent in the transverse direction intersecting the terminal insertion direction. In other words, these are bent toward the outside of the terminal accommodation chamber 11. Since the space 15*a* and the space 15*b* are provided at the outside of the terminal accommodation chamber 11, such a bending is not prohibited. Further, the space 15*a* allows the bending of the flexible arm 17 and the like of the terminal accommodation chamber 11 positioned at the left and right sides of the space. Thus, since the adjacent terminal accommodation chambers 11 share one space 15*a*, the connector housing 3 may be decreased in size.

As described above, since the flexible arm 17, the terminal pressing wall 19, and the locking lance 18 are bent outward so as to move away from the terminal 4, the terminal 4 can be smoothly inserted.

The above-described bending is continued until the contact portion 41 passes the locking lance 18. When the terminal 4 is completely inserted into the terminal accommodation chamber 11, the pressing from the contact portion 41 to the locking lance 18 is terminated. Accordingly, the locking lance 18 returns to the original state together with the flexible arm 17 and the terminal pressing wall 19. As a result, the engagement portion 18*b* is locked to the contact portion 41, and is accommodated inside the terminal accommodation chamber 11 with preventing the terminal 4 from coming off (see FIG. 9).

In the insertion of the terminal 4 into the terminal accommodation chamber 11, it is possible to check the insertion state of the terminal 4 by seeing the insertion detecting surface 20 in the middle of the terminal pressing wall 19.

Figure 7:
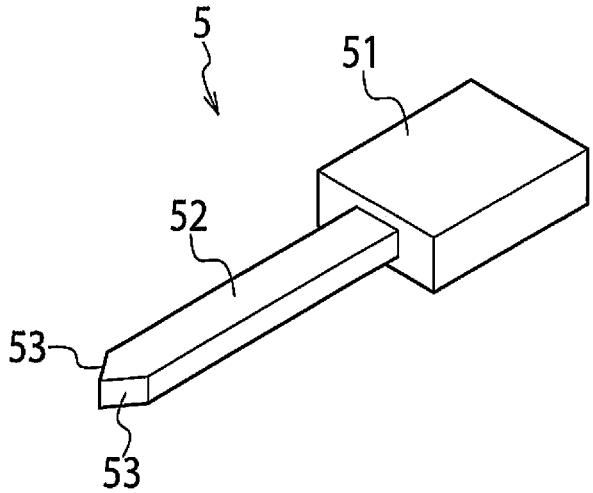
FIG. 7 is a perspective view illustrating a release tool which is used in an embodiment of the invention.
Figure 10:
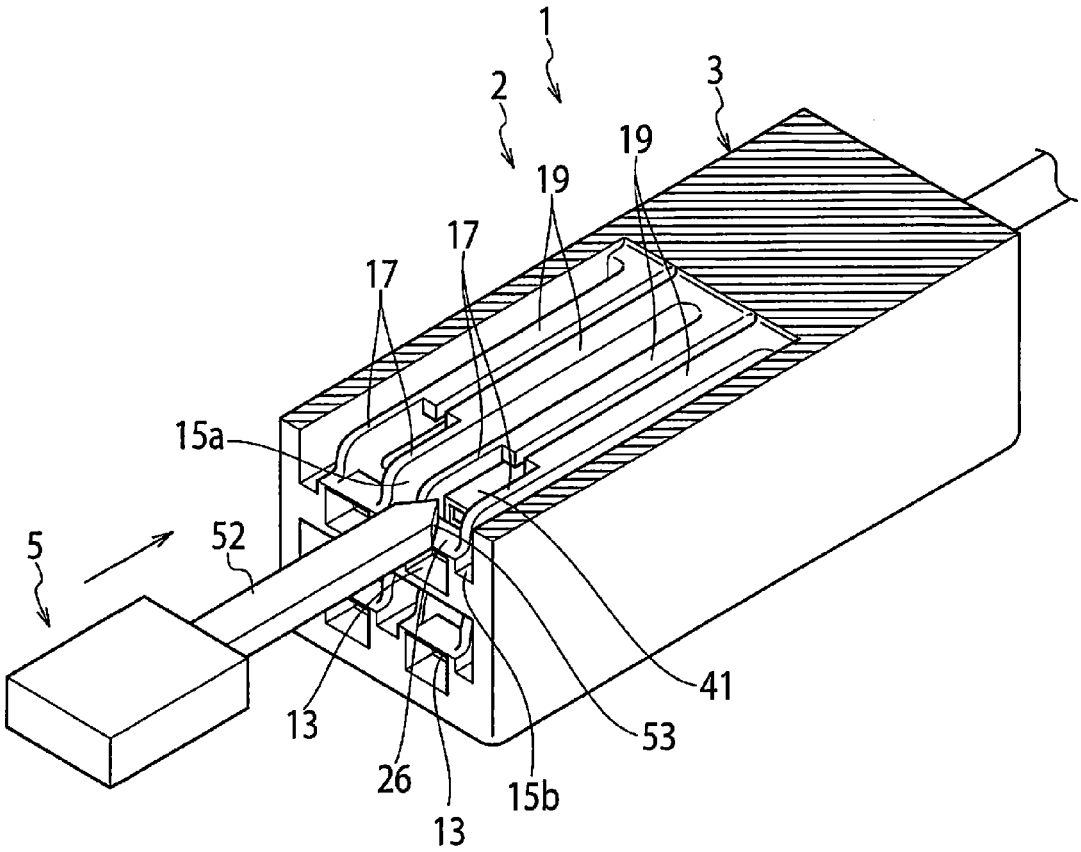
FIG. 10 is a perspective view illustrating a state where the terminal is extracted from the terminal accommodation chamber.

FIG. 10 shows an operation in extraction of the terminal 4 from the terminal accommodation chamber 11. In order to extract the terminal 4 from the terminal accommodation chamber 11, the release tool 5 is used. As shown in FIG. 7, the release tool 5 includes: a main body 51 configured to be gripped by fingers, and a release rod 52 formed extending from the body 51. The release rod 52 includes two pressing surfaces 53 in a front end thereof. The pressing surfaces 53 are positioned at the left and right sides, and are formed as tapered surfaces, which approaches to each other toward the front end of the release rod 52.

The release tool 5 is inserted from the tool insertion hole 26 into the terminal accommodation chamber 11 with the pressing surface 53 directed toward the terminal accommodation chamber 11. In this insertion, the pressing surface 53 of the release tool 5 slidably contacts with the left and right flexible arms 17 facing each other in the terminal accommodation chamber 11. Accordingly, the flexible arm 17, the terminal pressing wall 19, and the locking lance 18 are integrally bent toward the outside of the terminal accommodation chamber 11, so that the gap between the pair of flexible arms 17 and 17 is widened. With this deformation, the engagement portions 18*b* of the left and right locking lances 18 are deviated from the contact portion 41 of the terminal 4, so that the locking of the locking lance 18 is released. As a result, the terminal 4 can be extracted from the terminal accommodation chamber 11. In this way, since the terminal 4 can be extracted just by inserting the release tool 5 into the terminal accommodation chamber 11, it becomes easy to extract the terminal 4.

As described above, according to the embodiment, the locking lance 18 can be bent in the direction intersecting the insertion direction (i.e. transverse direction) of the terminal 4. Thus, the height of the connector housing 3 may be lowered. That is, a connector which is short in height may be provided.

The flexible arm 17 is connected to the inner wall 24 of the terminal accommodation chamber 11, and the flexible arm 17 is provided in such a manner as to extend further than the front end of the locking lance 18. Thus, the mechanical strength of the locking lance 18 can increase and the reaction force against the locking lance 18 in the bending direction can increase. In other words, it is possible to increase the locking force of the locking lance 18 with respect to the terminal 4. Furthermore, since the reaction force against the locking lance 18 in the bending direction is large, a retainer for regulating the bending of the locking lance 18 is not needed, so that the number of components can be decreased. Further, since the flexible arm 17 can be bent in the transverse direction intersecting the insertion direction of the terminal 4 together with the locking lance 18, the locking of the locking lance 18 with respect to the terminal 4 can be smoothly released and the locking release operation can be easily performed.

Further, since the terminal pressing wall 19, which presses the terminal 4 accommodated in the terminal accommodation chamber 11, is provided in the flexible arm 17, the terminal 4 can be pressed into the terminal accommodation chamber 11 and the terminal 4 may be prevented from coming off from the terminal accommodation chamber 11. Furthermore, since the terminal pressing wall 19 is integrally formed with the locking lance 18 and the flexible arm 17, the mechanical strength of the locking lance 18 increases and the reaction force in the bending direction further increases, thereby increasing the locking force with respect to the terminal 4.

Further, since the locking lance 18 and the flexible arm 17 are provided at the surfaces of the terminal accommodation chamber 11 that face to each other, it is possible to lock the terminal 4 from the left and right sides in the transverse direction and stably lock the terminal 4. Further, the front end surfaces of the terminal pressing walls 19 are formed as the insertion detecting surface 20, and the insertion state of the terminal 4 can be checked by confirming the gap between the insertion detecting surfaces 20.

Further, since the locking lance 18 is supported by the terminal accommodation chamber 11 with the double-side support beam structure, the reaction force in the bending direction increases due to its mechanical strength, so that the locking lance 18 (the engagement portion 18*b*) can be strongly locked to the terminal 4.

Furthermore, in the embodiment, the female connector has been exemplified, but the present invention may be applied to the male connector so as to be embodied.

What is claimed is:

1. A terminal locking structure for locking a terminal in a terminal accommodation chamber of a connector housing, the terminal locking structure comprising:

a pair of flexible arms formed bendable to move away from each other in the direction intersecting the insertion direction of the terminal into the terminal accommodation chamber, each flexible arms being integrally formed with a locking lance configured to lock the terminal to prevent the terminal from coming off from the terminal accommodation chamber; and a pair of terminal holding walls each integrally formed with each flexible arm and its locking lance along each flexible arm, each terminal holding wall being configured to press the terminal accommodated in the terminal accommodation chamber toward a wall of the terminal accommodation chamber facing the terminal;

wherein each flexible arm is formed extending from a front end of the locking lance thereof to the insertion opening side provided for a corresponding terminal in the terminal accommodation chamber and is connected to an inner wall of the terminal accommodation chamber.

2. The terminal locking structure according to claim 1, wherein the locking lance and the flexible arm are provided in each of surfaces of the terminal accommodation chamber facing to each other, and the terminal holding wall includes an insertion detecting surface at a front end thereof, the insertion detecting surface being visible from the insertion opening of the terminal accommodation chamber.

3. The terminal locking structure according to claim 1, wherein the locking lance includes:

a flexible support portion being connected to the terminal insertion side of the terminal accommodation chamber at one end thereof, the other end of the flexible support portion being provided in the insertion opening side of the terminal accommodation chamber; and an engagement portion provided at the front end side of the flexible support portion and engages with the terminal inserted in the terminal accommodation chamber.

4. The terminal locking structure according to claim 2, wherein the locking lance includes:

a flexible support portion being connected to the terminal insertion side of the terminal accommodation chamber at one end thereof, the other end of the flexible support portion being provided in the insertion opening side of the terminal accommodation chamber; and an engagement portion provided at the front end side of the flexible support portion and engages with the terminal inserted in the terminal accommodation chamber.

* * * * *